US006499237B2

(12) United States Patent
Johnson

(10) Patent No.: US 6,499,237 B2
(45) Date of Patent: Dec. 31, 2002

(54) SNOW BLOWER

(76) Inventor: John Johnson, P.O. Box 6400, Lubbock, TX (US) 79433

( * ) Notice: Subject to any disclaimer, the term of this patent is extended or adjusted under 35 U.S.C. 154(b) by 16 days.

(21) Appl. No.: 09/838,819

(22) Filed: Apr. 19, 2001

(65) Prior Publication Data

US 2002/0095824 A1 Jul. 25, 2002

Related U.S. Application Data

(60) Provisional application No. 60/251,452, filed on Dec. 5, 2000.

(51) Int. Cl.[7] ..... E01H 5/09
(52) U.S. Cl. ..... 37/251
(58) Field of Search ..... 37/248, 244, 246, 37/247, 249, 251, 252

(56) References Cited

U.S. PATENT DOCUMENTS

| | | | | | |
|---|---|---|---|---|---|
| 2,219,204 | A | * | 10/1940 | Wandscheer | 37/248 |
| 2,482,213 | A | * | 9/1949 | Ritchie | 37/252 |
| 2,815,590 | A | * | 12/1957 | Fiacco | 37/251 |
| 4,367,603 | A | * | 1/1983 | Schlapman | 37/251 |
| 4,541,187 | A | * | 9/1985 | Phelps | 37/251 |
| 4,836,320 | A | | 6/1989 | Sundin | 180/19.1 |
| 5,101,585 | A | | 4/1992 | Gerbrandt | 37/252 |
| 5,438,770 | A | | 8/1995 | Miller | 37/227 |
| 5,479,730 | A | | 1/1996 | Gogan | 37/231 |

* cited by examiner

*Primary Examiner*—Robert E. Pezzuto
(74) *Attorney, Agent, or Firm*—Wendell Coffee

(57) ABSTRACT

A snow blower augers snow scrapped from a path to a fan. The fan is co-axial with the auger at one end of an auger housing. A fan shaft extends through an auger tube. The fan shaft is supported on one end by a fan housing bearing attached to the housing and at the other end by a bearing in the auger tube. The auger is supported at one end by a drive housing bearing attached to the housing and at the other end by a bearing on the fan shaft. This arrangement makes it possible to have an open passage for the snow to move from the auger to the fan.

6 Claims, 3 Drawing Sheets

SNOW BLOWER

REFERENCE TO PROVISIONAL PATENT APPLICATION

The applicant claims the benefit of his U.S. Provisional Application No. 60/251,452, filed Dec. 5, 2000.

BACKGROUND OF THE INVENTION (1) Field of the Invention

This invention relates to snow blowers. After snow falls it is desirable to remove the snow from paths. As used herein the term "paths" would normally include sidewalks and pedestrian paths as well as drive ways and in some cases roadways. Occasionally, the "paths" for cleaning the snow away will include parking lots and other areas. However, in each instance of clearing an area the snow blower will usually clean adjacent paths within the area.

The majority of snow blowers are powered by internal combustion engines although some may be powered by electric motors. In typical operation a scrapper lifts the snow into a housing where augers move the snow to a fan which then blows the snow out of a chute.

Larger snow blowers are mounted upon wheeled vehicles. A driver is seated on the vehicle to which the snow blower is attached either permanently or as a unit to a multipurpose mobile vehicle. Snow blower operators and repairmen have ordinary skill in this art.

(2) Description of the Related Art

In some snow blowers, Gerbrandt U.S. Pat. No. 5,101,585 for example, the fan is attached to the auger so that the fan rotates at the same speed as the auger.

In other snow blowers, Gogan U.S. Pat. No. 5,479,730 for example, the fans are mounted at right angles to the augers.

SUMMARY OF THE INVENTION (1) Progressive Contribution to the Art

A snow blower according to this invention moves the snow by an auger at right angles to the travel of the snow blower. The snow is moved to one end of the auger, where a fan catches the snow and blows it through a chute. The fan axis is co-axial with the auger axis. The fan rotates over five (5) times the speed of the auger. This is achieved by mounting a fan upon a shaft which extends though a hollow tube upon which the auger is attached. By this construction, the auger delivers the snow to the fan through an open passageway. There are no supports for the fan shaft between the auger and the fan. Therefore, it is not necessary to change the direction of the snow or to move the snow through supports between for the rotating shafts.

This blower is designed to be carried on the front of an all terrain vehicle. The design make it possible to have the entire snow blower unit very close to the front of the vehicle, therefore there is less weight upon the front wheels of the vehicle.

The total weight of the blower and the vehicle is better distributed to the vehicle wheels. This results in better steering and traction.

(2) Objects of this Invention

An object of this invention is to remove snow from a path.

Another object of this invention is to remove snow from a path using a small vehicle with a compact snow blower.

Further objects are to achieve the above with devices that are sturdy, compact, durable, lightweight, simple, safe, efficient, versatile, ecologically compatible, energy conserving, low maintenance and reliable, yet inexpensive and easy to manufacture, install, operate, and maintain.

Other objects are to achieve the above with a method that is rapid, versatile, ecologically compatible, energy conserving, efficient, and inexpensive, and does not require highly skilled people to install, operate, and maintain.

The specific nature of the invention, as well as other objects, uses, and advantages thereof, will clearly appear from the following description and from the accompanying drawings, the different views of which are not necessarily scale drawings.

CATALOGUE OF ELEMENTS

Figure 1:
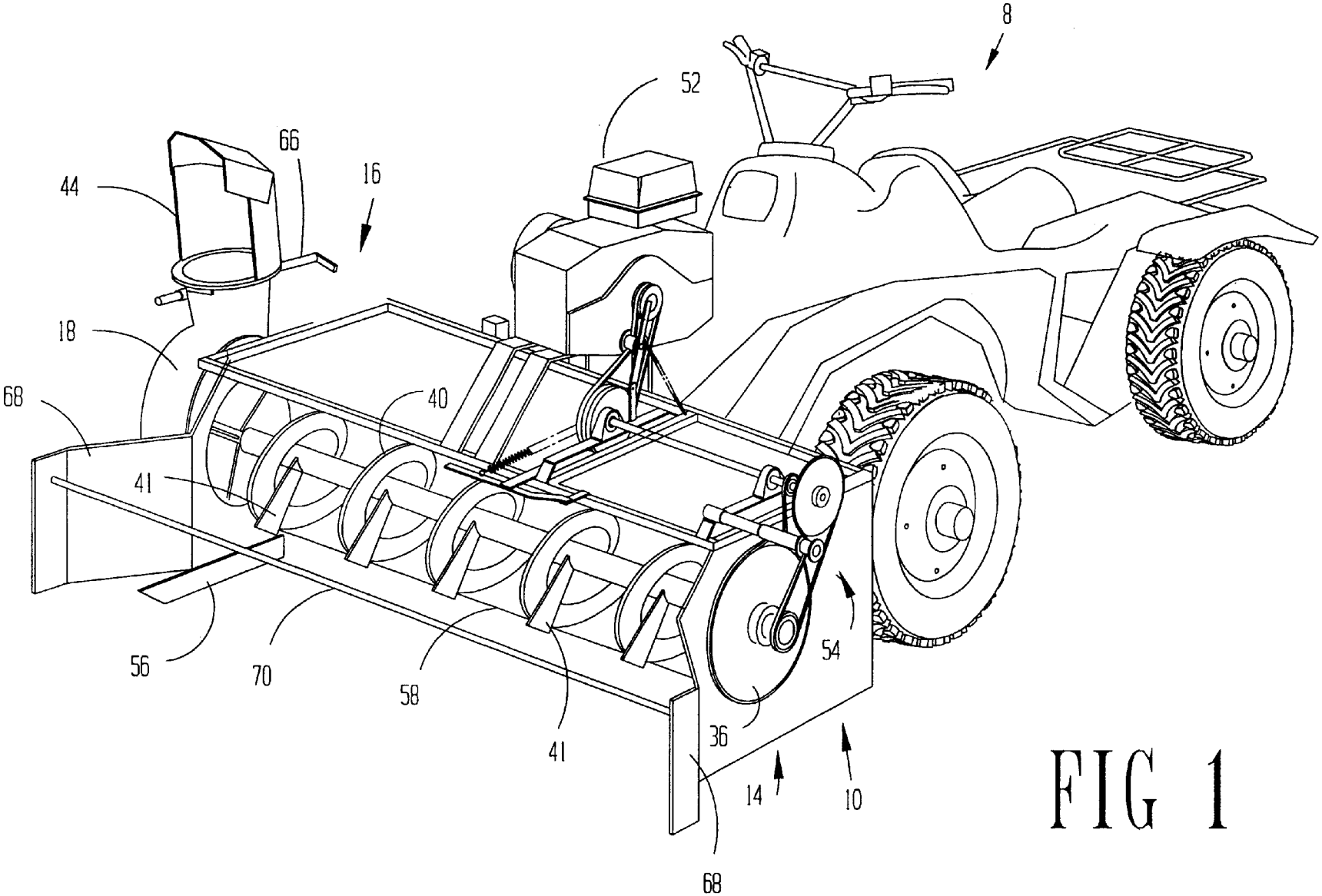
FIG. 1 is a perspective view of a snow blower according to this invention shown attached to a carrying vehicle with the cover over the drive means removed to show the drive means.
Figure 2:
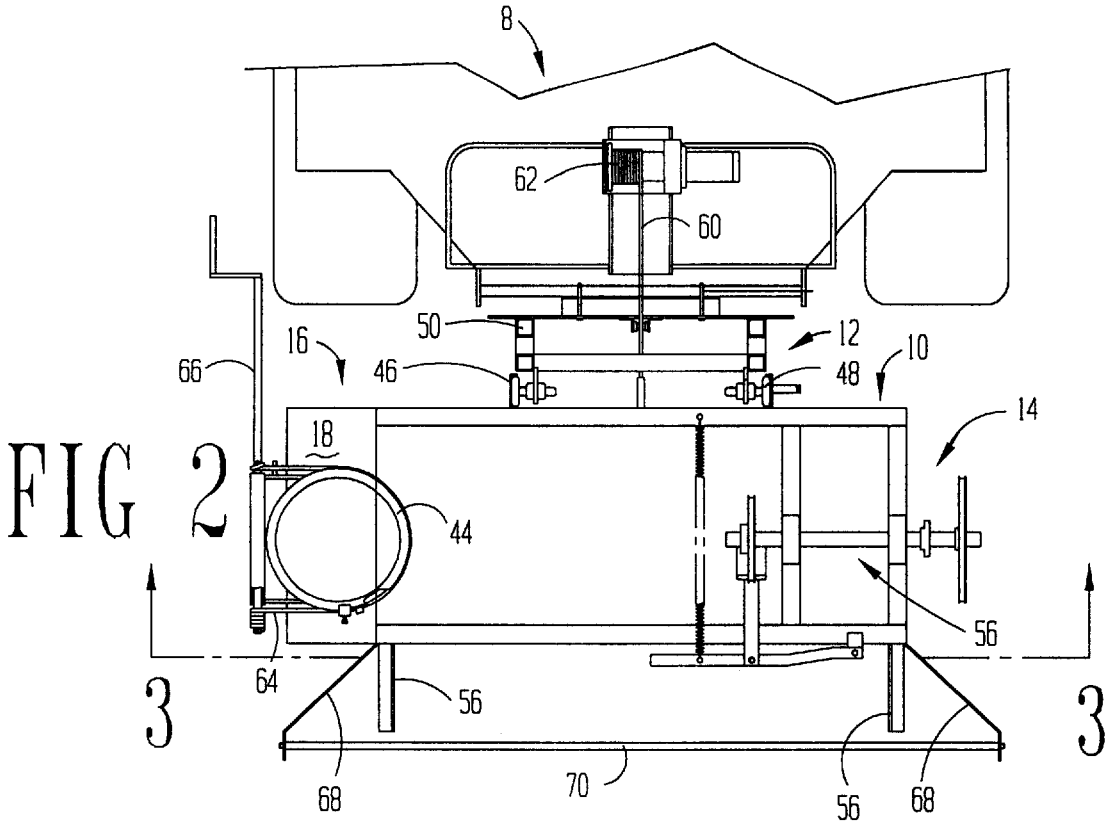
FIG. 2 is a sectional plan view of the snow blower taken substantially on line 2—2 of FIG. 3, with the attached vehicle partially shown.
Figure 3:
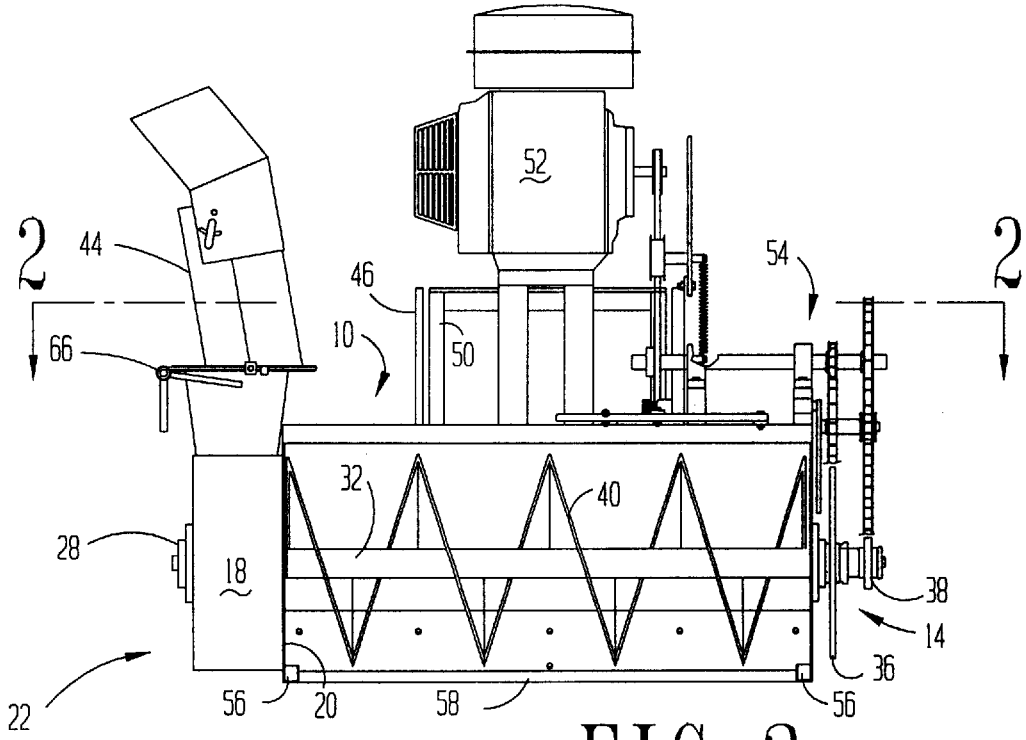
FIG. 3 is a front elevational view of the snow blower taken substantially on line 3—3 of FIG. 2, with the auger supports and ice breakers not shown.
Figure 4:
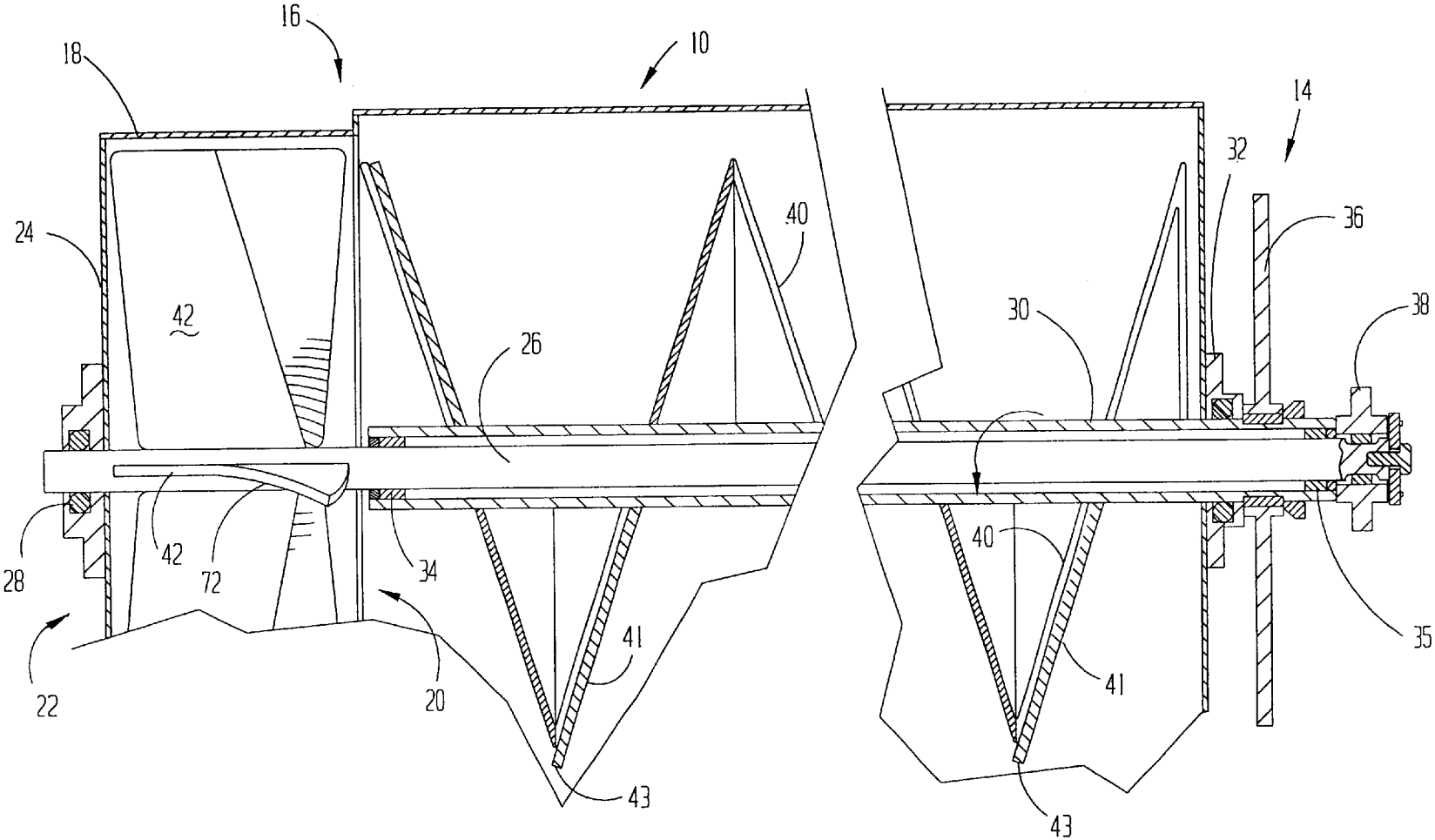
FIG. 4 a sectional view of the fan on its shaft, the auger on its tube, the four bearings, and the supporting structure.

As an aid to correlating the terms of the claims to the exemplary drawing(s), the following catalog of elements and steps is provided:

| | |
|---|---|
| 8 | vehicle |
| 10 | auger housing |
| 12 | connection |
| 14 | housing drive end |
| 16 | fan end |
| 18 | fan housing |
| 20 | open end |
| 22 | disc end |
| 24 | fan disc |
| 26 | fan shaft |
| 28 | fan bearing |
| 30 | auger tube |
| 32 | auger bearing |
| 34 | bearing in tube |
| 35 | second bearing in tube |
| 36 | auger rotate means i.e. sprocket |
| 38 | fan rotate means i.e. |
| 40 | auger |
| 41 | auger supports |
| 42 | fan blades |
| 43 | ice breaker |
| 44 | chute |
| 46 | rails |
| 48 | rollers |
| 50 | frame |
| 52 | motor |
| 54 | drive means |
| 56 | skids |
| 58 | scraping blade |
| 60 | cable |
| 62 | windless |
| 64 | chute cable |
| 66 | cable shaft |
| 68 | wings |
| 70 | rod |
| 72 | curvature |

DESCRIPTION OF THE PREFERRED EMBODIMENT

According to this invention there will be a source of snow that the snow blower (blower) moves over. Common areas where snow may accumulate and that may be cleared using this invention include driveways, sidewalks, parking lots, roads, or any other surface that the user desires to clear of fallen snow. These common areas are sometimes referred to as "paths" herein.

The blower unit is free standing unit allowing for a carrying vehicle 8 to be attached to or removed from the blower unit. Once the blower has been correctly attached to the carrying vehicle, the blower can be adjusted vertically in height dependent on the thickness of snow.

Those with ordinary skill in the art are aware that as snow depth increases it may become necessary to raise the blower necessitating multiple passes before the path is cleared. Adjustable skids 56 mounted to the bottom of auger housing 10 allow for minor height adjustments. Additionally, the blower unit may be raised or lowered by rails 46 connected to the auger housing 10 and rollers 48 attached by frame 50 to the carrying vehicle 8. This raising and lowering may be accomplished manually. However, the preferred means is by attaching a cable 60 to the back of the auger housing 10 where the cable is extended and retracted from a battery powered windlass 62 mounted on the vehicle 8.

As the carrying vehicle 8 with mounted blower travels over the snow, the snow entering the auger housing 10 is channeled towards a fan end 16 by auger 40. A scraping blade 58 located at the bottom of the auger housing 10 under the auger 40 spans the width of the auger housing 10. The blade 58 functions to push any snow the auger 40 does not capture into the auger housing 10 and thus the auger 40. Once the snow reaches the fan end 16, fan blades 42 propel the snow vertically through directional chute 44.

The user can adjust the direction of snow discharge by rotating the directional chute 44. A chute cable 64 extends around the chute with one end wrapped over the top of a cable shaft 66. The other end is wrapped around under the cable shaft 66. This provides easy rotation of the chute 44.

The auger housing 10 has a housing drive end 14 and the fan end 16 encasing the auger 40. The initial means for moving the snow is encased by this auger housing. The auger housing 10 has a discharge opening at the fan end 16 leading to fan housing 18. The span of the auger housing 10 is open to the auger 40 to provide entry for snow.

Wings 68 pull the snow from outside the width of the drive end 14 and the fan end 16 into the auger housing 10. The wings are connected by rod 70 as seen in FIG. 1.

Vertically adjustable skids 56 are mounted to the bottom of the auger housing 10 by fastening devices (bolts, etc.) securing the skids. In addition to this means for minor adjustment, the rollers 48 attached to frame 50 and riding in the rails 46 provide for major vertical adjustments, as explained earlier.

The fan end 16 of the housing 10 is connected to cylindrical fan housing 18 which has an open end 20 and a disc end 22. The open end 20 receives the snow which is moved to the fan blades 42 by the auger 40. It is emphasized that there is no obstruction between the auger 40 and the fan blades 42. Stated otherwise, there is an open passageway from the auger to the fan. This arrangement is free of any interference allowing for all of the flow of snow entering the fan housing 18 to proceed directly into the fan blades 42 and out the discharge chute 44 with no obstruction, and minimum change of direction.

A fan disc 24 closes the disc end 22 of the fan housing 18. Fan shaft 26 is telescoped in auger tube 30 and is supported by two bearings, fan bearing 28 attached to the fan disc 24 of the housing 18 and one bearing 35 in the tube 30 at the drive end 14. The fan shaft 26 extends co-axially through a bearing 34 in the auger tube 30. The fan shaft 26 is aligned with the auger housing 10. The auger tube 30 is supported by two bearings, the auger bearing 32 on the housing drive end 14 of the housing 10 and the bearing 34 on the shaft 26 in the tube 30.

The auger 40, extends coaxially from and along the auger tube 30 from the drive end 14 to the fan end 16 of said auger tube. The coiled, helical formation of the blade works to push the snow entering the auger housing towards the fan end 16. The auger 40 is connected to the auger tube 30 by supports 41 that extend radially from the auger tube 30 slightly past the outer most edge of the auger 40 forming an extension or ice breaker 43. The ice breaker 43 will crush ice which may form on the blade 58 or housing 10. Also it is not uncommon for ice to lie underneath the loose snow, these support ice breakers 43 work to break it up.

The auger tube 30 is connected at the housing closed end 14 to an auger rotating means 36 in the form of a sprocket for rotating the tube at an auger speed. The fan shaft 26 is connected at the housing end 14 to a fan rotating means 38 (another sprocket) for rotating the fan shaft 26 at a fan speed which is faster than the auger speed. Relative rotational velocity between the auger tube 30 and the fan shaft 26 may vary, but the speed of the fan shaft 26 should be at least approximately five (5) times that of the auger tube 30. A fan speed thirteen (13) times the auger speed seems to be the optimum while larger ratios are operable. A motor 52 with a drive means 54 attached to both a top of the rails 46 and the auger housing 10 is also attached to the means for rotating the fan shaft 38 and the auger tube 30. Preferably the motor 52 is an internal combustion engine.

The fan blades 42 used to discharge the snow have curvature 70 on the leading edge to better capture and then release the snow into the directional chute 44.

Furthermore, it can be seen that alternative means for vertical adjustment of the auger housing, means 38 for driving the fan shaft and means 36 for driving the auger tube other than what is mentioned in this application would still be operable. The speed and means set forth are the preferred embodiment in part based on efficiency, simplicity, and cost effectiveness.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific example above do not point out what an infringement of this patent would be, but are to point out the advantages and the progressive contribution to the snow blowing art and to enable one skilled in the art to make and use the invention. The limits of the invention and the bounds of the patent protection are measured by and defined in the following claims.

I claim as my invention:

1. A snow blower comprising:

a) a housing having a fan end and a drive end, b) a fan shaft telescoped in c) an auger tube, d) the fan shaft supported by two bearings, one on the fan end of the housing, e) the auger tube supported by two bearings, one on the drive end of the housing, f) fan blades on the shaft at the fan end and g) a means on the shaft for rotating the shaft, h) an auger on the auger tube, i) a means on auger tube at the drive end for rotating the auger tube, j) means for connecting the housing to a carrying vehicle having, k) a pair of vertical rails forming a track attached to the housing, l) rollers on a frame which is adapted to be fixed to a carrying vehicle, and m) the rollers riding in the tracks of the rails.

2. The snow blower as defined in claim 1 further comprising:

n) a motor attached both to a top of the rails, and to a top of the auger housing, and o) the motor connected to the means for rotating the shaft and the means for rotating the tube.

3. The snow blower as defined in claim 1 having a means to raise and lower the housing comprising:

n) a battery-powered windlass attached to the carrying vehicle with o) a cable extending from the windlass to the housing.

4. A snow blower comprising:

a) an auger housing, b) means for connecting the auger housing to a carrying vehicle, c) the auger housing having a closed end and a fan end, d) the fan end in the form of a cylindrical fan housing having open end and a disk end, e) a fan disk closing the disk end of the fan housing, f) a fan shaft aligned with the auger housing journalled in g) a bearing at the fan disk, h) an auger tube aligned with the auger housing journalled in a bearing on the housing closed end, i) said fan shaft extending through j) a fan shaft bearing in the auger tube co-axial with the auger tube, k) auger rotating means connected to the auger tube for rotating the tube at an auger speed, l) a fan rotating means connected to the fan shaft for rotating the fan shaft at a fan speed which is faster than the auger speed, m) an auger on the auger tube designed and constructed to move snow to the fan housing, n) fan blades on the fan shaft designed and constructed to blow snow through o) a chute on the fan housing, p) a pair of vertical rails forming tracks attached to the housing, q) rollers riding on a frame fixed to a carrying vehicle, r) the rollers riding in the tracks of the rails, s) whereby the housing may be adjusted to a desired elevation and t) a battery powered windlass attached to the carrying vehicle with, u) a cable extending from the windlass to the housing.

5. A snow blower comprising:

a) an auger housing, b) means for connecting the auger housing to a carrying vehicle, c) the auger housing having a closed end and a fan end, d) the fan end in the form of a cylindrical fan housing having open end and a disk end, e) a fan disk closing the disk end of the fan housing, f) a fan shaft aligned with the auger housing journalled in g) a bearing at the fan disk, h) an auger tube aligned with the auger housing journalled in a bearing on the housing closed end, i) said fan shaft extending through j) a fan shaft bearing in the auger tube co-axial with the auger tube, k) auger rotating means connected to the auger tube for rotating the tube at an auger speed, l) a fan rotating means connected to the fan shaft for rotating the fan shaft at a fan speed which is faster than the auger speed, m) an auger on the auger tube designed and constructed to move snow to the fan housing, n) fan blades on the fan shaft designed and constructed to blow snow through o) a chute on the fan housing, p) said means for connecting the auger housing to a carrying vehicle include: a pair of vertical rails forming tracks attached to the housing, q) rollers riding on a frame fixed to a carrying vehicle, r) the rollers riding in the tracks of the rails, s) whereby the housing may be adjusted to a desired elevation, t) a motor attached to both a top of the tracks, and a top of the auger housing, and u) drive means for driving the shaft and driving the auger tube inter connecting the motor and the shaft and auger tube.

6. The snow blower as defined in claim 5 wherein:

v) said drive means rotates the fan shaft at least five (5) times the speed the auger tube is rotated.

* * * * *